US006671490B2

(12) United States Patent
Suenaga

(10) Patent No.: US 6,671,490 B2
(45) Date of Patent: Dec. 30, 2003

(54) IMAGE FORMING APPARATUS

(75) Inventor: Takenori Suenaga, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/358,032

(22) Filed: Feb. 4, 2003

(65) Prior Publication Data

US 2003/0147681 A1 Aug. 7, 2003

(30) Foreign Application Priority Data

Feb. 5, 2002 (JP) ..... 2002-027917

(51) Int. Cl.[7] ..... G03G 15/20
(52) U.S. Cl. ..... 399/406; 162/271; 271/209
(58) Field of Search ..... 399/122, 320, 399/322, 323, 328, 406; 162/270, 271; 271/209

(56) References Cited

U.S. PATENT DOCUMENTS 5,187,527 A * 2/1993 Forlani et al. ..... 399/328
6,002,913 A * 12/1999 Pawlik et al. ..... 399/406
6,282,403 B1 * 8/2001 Spencer et al. ..... 399/406

* cited by examiner

*Primary Examiner*—Hoang Ngo
(74) *Attorney, Agent, or Firm*—Muserlian, Lucas and Mercanti, LLP

(57) ABSTRACT

This invention relates to an image forming apparatus that can correct a curl of a transfer medium correctly and smoothly. This image forming apparatus includes a curl correcting mechanism, including a rotatable sponge roller and a fixed press member which presses the sponge roller while biting into part of the outer surface of the sponge roller, and provided downstream of a fixing processing unit, and a regulating unit, provided immediately before the curl correcting means, so as to guide the leading end of the transfer medium to that position on the outer surface of the sponge roller which is tilted, within the range of 5° to 10° (both inclusive) from a reference line that connects the center of the sponge roller and the press start position of the press member with respect to the sponge roller, to a direction opposite to the rotating direction of the sponge roller.

8 Claims, 4 Drawing Sheets

IMAGE FORMING APPARATUS

BACKGROUND OF THE INVENTION

1. Field of the Invention

The present invention relates to an image forming apparatus, e.g., a copying machine or printer, which forms an image electrophotographically and, more particularly, to an image forming apparatus in which a toner-image-bearing transfer medium (to be referred to as a sheet hereinafter) after the fixing process can be correctly guided to a curl correcting means.

2. Description of the Related Art

According to some copying machine, a latent image formed on a photosensitive body through exposure (writing) in accordance with a document or image data is made visible by developing. The obtained toner image is transferred to the first surface (obverse surface) of a sheet by the operation of a transfer means, and is fixed by a heat roller type fixing unit. After that, the sheet is reversed by a reversing mechanism, and is fed to a transfer region again. Then, another toner image is transferred on the second surface (reverse surface) of the sheet. In this copying machine, conventionally, a curl (curling tendency) tends to occur in the sheet during the fixing process. Hence, after curling occurs, the sheet conveying performance degrades, and image transfer to the second surface of the sheet cannot be performed well.

In order to cope with these problems, a curl correcting means (curl correcting mechanism) may be added with which the sheet is drawn through a sponge roller pair by applying a force opposite to the direction of curl to the sheet after the fixing process, so that the curl is corrected. With this sponge roller method, the linear velocity of the sheet is difficult to manage. Simultaneously, the sheet cannot be regulated such that the leading end of the curled sheet is clamped well by the sponge roller pair. Thus, a satisfactory result cannot be obtained.

More specifically, for example, a sponge roller pair is provided at a position downstream of a fixing processing means and comparatively close to the fixing processing means. The fixing processing means has, as main constituent elements, an upper fixing roller incorporating a heat source, and a lower fixing roller which rotates in tight contact with the upper fixing roller. A guide member is provided at a position immediately before the sponge roller pair.

The guide member is arranged to guide the leading end of the sheet toward the nip position of the sponge roller pair.

It is, however, difficult to obtain an approach angle of the sheet for the nip of the sponge roller pair stably, and paper jamming and corner bent of the sheet occur often.

These inconveniences are apparently related to the arrangement itself of the curl correcting means and partly to the approach path of the sheet which extends from the fixing section to the curl correcting means.

SUMMARY OF THE INVENTION

The present invention has been made in view of the above problems, and has as its object to provide an image forming apparatus having such an arrangement that a sheet after the fixing process can be sent to a curl correcting means in a stable state.

In order to achieve the above object, according to the first aspect of the present invention, there is provided an image forming apparatus having an image carrier, image forming means for forming a toner image on the image carrier, transfer means for transferring the toner image formed on the image carrier onto a transfer medium, and fixing processing means including a pair of upper and lower fixing rollers for fixing the toner image onto the transfer medium, wherein the apparatus comprises curl correcting means, including a rotatable sponge roller and a fixed press member which presses the sponge roller while biting into part of an outer surface of the sponge roller, and provided downstream of the fixing processing means, and regulating means, provided immediately before the curl correcting means, so as to guide a leading end of the fixing-processed transfer medium to that position on the outer surface of the sponge roller which is tilted, within a range of 5° to 10° (both inclusive) from a reference line that connects a center of the sponge roller and a press start position of the press member with respect to the sponge roller, to a direction opposite to a rotating direction of the sponge roller.

According to the second aspect of the present invention, there is provided an image forming apparatus wherein the sponge roller according to the first aspect is rotated at a linear velocity larger than those of the pair of upper and lower fixing rollers, and the linear velocity of the sponge roller is 325 mm/s to 329 mm/s.

According to the third aspect of the present invention, there is provided an image forming apparatus wherein the sponge roller according to the second aspect has a rubber hardness of 2 degrees to 12 degrees (both inclusive) measured by Asker C measurement, and the press member bites into the sponge roller by a bite amount of 2.0 mm at a deepest portion.

According to the fourth aspect of the present invention, there is provided an image forming apparatus wherein the regulating means according to the first aspect comprises a first regulating member which has a regulating surface formed of an arcuate recessed surface formed on an approaching side of the fixing-processed transfer medium and a flat surface formed on an outlet side of the transfer medium continuously to the arcuate recessed surface, and a second regulating member which has a regulating surface formed of an arcuate projecting surface formed on an approaching side of the fixing-processed transfer medium and a flat surface formed on an outlet side of the transfer medium continuously to the arcuate projecting surface, and which is arranged to oppose the first regulating member.

According to the third aspect of the present invention, there is provided an image forming apparatus further having, downstream of the curl correcting means, a reversal delivery/re-feeding mechanism for reversely delivering and re-feeding the transfer medium which is curl-corrected through the regulating means and the curl correcting means according to the first aspect, wherein the regulating means further comprises a convey path switching member which can direct the transfer medium toward the reversal delivery/re-feeding mechanism.

As is apparent from the above aspects, according to the present invention, the arrangement of the regulating member which is located at a position where it is easily thermally affected by heat associated to fixing is improved, and sheet feeding to the curl correcting means can be performed stably. Thus, the curling tendency of the sheet is corrected reliably, and accordingly image formation on the second surface of the sheet can be performed well.

DETAILED DESCRIPTION OF THE PREFERRED EMBODIMENT

A preferred embodiment of the present invention will be described with reference to the accompanying drawings.

Figure 1:
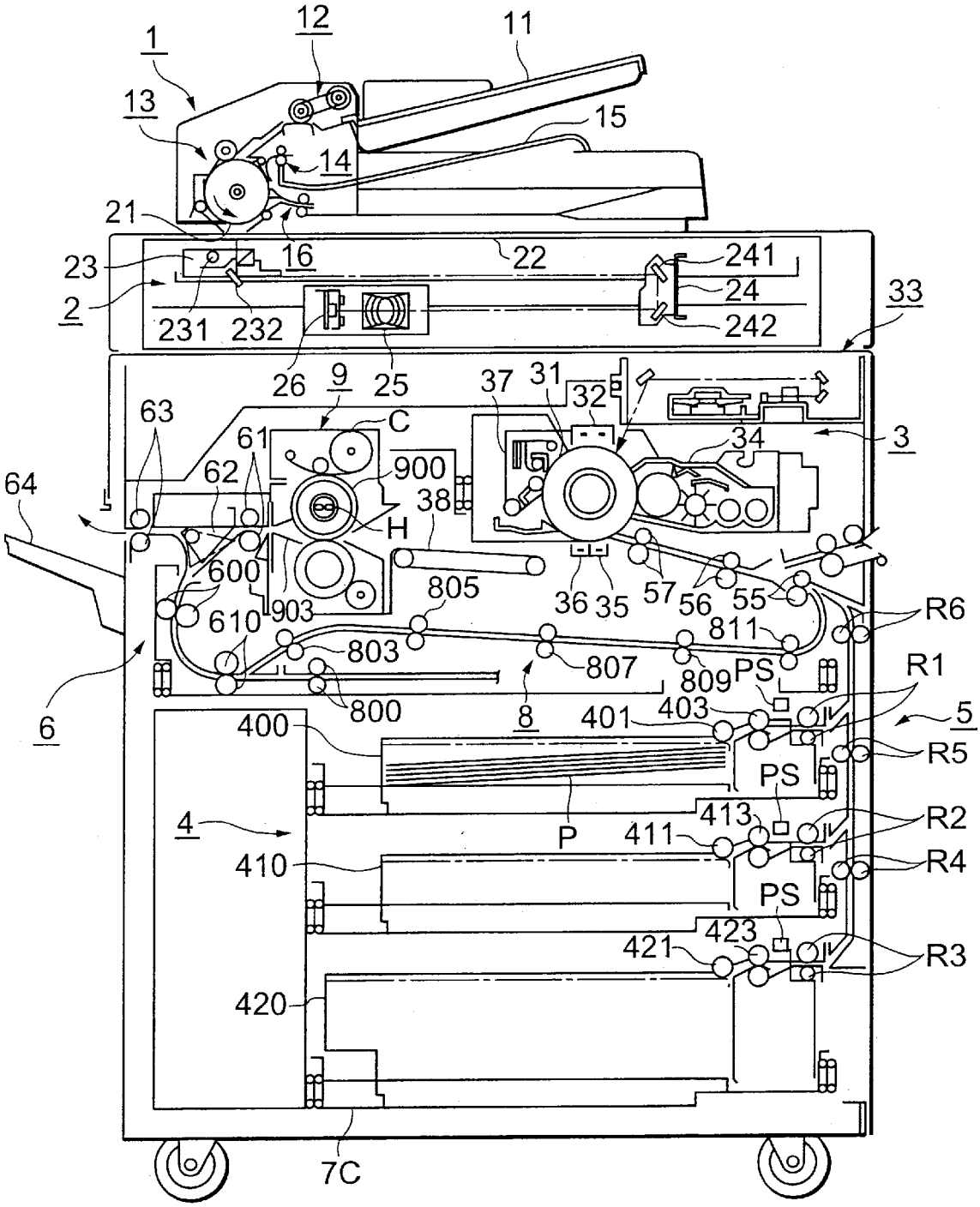
FIG. 1 is a schematic view showing the overall arrangement of a digital copying machine as an example of an image forming apparatus.

As shown in FIG. 1, an image forming apparatus of this embodiment is exemplified by a digital copying machine having an automatic document feeder 1, image reading unit 2, image forming section 3, sheet storing section 4, sheet feeding section 5, reversal delivery/re-feeding section 6, and reversal convey section 8.

The automatic document feeder 1 feeds out document sheets one by one to convey them to an image reading position and delivers the document sheets after image reading to a predetermined position.

The automatic document feeder 1 has a document table 11 on which a document is to be placed, a document separating means 12 for separating the document placed on the document table 11, a document conveying means 13 including a plurality of rollers which convey the document separated by the document separating means 12, a document delivery means 14 for delivering the document conveyed by the document conveying means 13, a document delivery table 15 on which the document delivered by the document delivery means 14 is to be placed, and a document reversing means 16 comprised of a reversing roller pair for turning over the document in the double-sided copy mode.

A plurality of document sheets (not shown) placed on the document table 11 are separated one by one by the document separating means 12, and are conveyed by the document conveying means 13 toward an image reading position.

The document reading position is located below the document conveying means 13. At this position, the image of the document is read through a slit 21 of the image reading unit 2.

The document from which the image has been read is delivered onto the document delivery table 15 by the document delivery means 14.

When reading images on the two sides of the document, the document from which the image on one side has been read is guided to the document reversing means 16. When the trailing end of the document is clamped by the reversing roller pair constituting the document reversing means 16, the reversing roller pair is rotated in the reverse direction to turn over the document. Then, the document is conveyed by the document conveying means 13 again, and the image on the other side (second surface) can be read at the document reading position.

This process is repeated a number of times corresponding to the number of the document sheets placed on the document table 11.

The automatic document feeder 1 can be raised. When the automatic document feeder 1 is raised upright to open up the space above a platen glass plate 22, a document can be placed directly on the platen glass plate 22 and be copied.

The image reading unit 2 serves to read the image of the document to obtain image data. The image reading unit 2 has a first mirror unit 23 formed by integrating a lamp 231 which illuminates the document through the slit 21 and a first mirror 232 which reflects light from the document, a second mirror unit 24 formed by integrating a second mirror 241 which reflects light from the first mirror 232 and a third mirror 242, an image forming lens 25 which causes the light reflected by the second mirror unit 24 to form an image on a CCD (to be described later) serving as an imaging element, and a linear CCD 26 which obtains image data by photoelectrically converting the optical image formed by the image forming lens 25.

The image data is subjected to an appropriate image process, and is then stored once in a memory (not shown).

When the document which is being fed by the automatic document feeder 1 is to be read by the image reading unit 2, the first and second mirror units 23 and 24 are fixed at positions shown in FIG. 1.

When the image of the document directly placed on the platen glass plate 22 is to be read, the image is read by moving the first and second mirror units 23 and 24 along the platen glass plate 22 while maintaining their optical path lengths.

The image forming section 3 is an image forming region where a toner image formed by using an electrophotographing process is transferred onto a sheet. The image forming section 3 has a photosensitive drum 31 having a photoconductive photosensitive layer serving as an image carrier on its surface, a charging unit 32 for uniformly charging the surface of the photosensitive drum 31, a laser write system 33 serving as an exposure means which is operated based on the image data after image processing and exposes the photosensitive drum 31 to form an electrostatic charge latent image, a developing unit 34 for reversely developing the electrostatic charge latent image formed on the photosensitive drum 31 to form a toner image, a transfer electrode 35 for transferring the visible toner image onto the sheet, a discharging unit 36 for performing AC corona discharge from the reverse surface of the sheet, on which the toner image has been transferred, thus promoting separation of the sheet from the photosensitive drum 31, a cleaning means 37 for cleaning the photosensitive drum 31 after the transfer step, and the like.

Reference numeral 38 denotes a convey belt for conveying the separated sheet toward a heat roller type fixing unit 9; and 63, delivery rollers.

In the above arrangement, if an image is formed by transferring a toner image onto the sheet, the constituent members, ranging from the image carrier 31 to the transfer electrode 35, make up the image forming means.

The fixing unit 9 has, as a main element, a fixing processing means comprised of an upper fixing roller 900 which incorporates a heating source H and rotates about it independently, and a lower fixing roller 903 which rotates in tight contact with the upper fixing roller 900, and integrally has fixing delivery rollers 61, a switching means/first regulating means (to be referred to as switching means or first regulating means depending on the situation hereinafter, and will be referred to as the switching means in the description of FIG. 1 and as the first regulating means in the description of FIG. 2) 62, having the function of a switching means (switching member) which selectively switches the sheet convey path and the function of a regulating member which regulates the behavior of the sheet under conveyance, a curl correcting means, and the like.

The curl correcting means is arranged at a position before convey rollers 600 provided downstream of the fixing delivery rollers 61. The curl correcting means is omitted in FIG. 1 due to the limited space, and will be described with reference to FIG. 2 together with a second regulating member 65 according to the present invention which is arranged to oppose the first regulating member 62, and the like.

Reference numeral C in FIG. 1 denotes a cleaning web provided in contact with the surface of the upper fixing roller 900. The cleaning web C is taken up little by little by a take-up core shown on the left side of FIG. 1 at an appropriate time interval during the operation of the apparatus.

Image formation with the above arrangement is achieved in the following manner. The photosensitive drum 31 which is rotated by an appropriate driving means in a direction indicated by an arrow is sequentially charged by the charging unit 32. After that, the laser write system 33 performs dot exposure to form an electrostatic charge latent image corresponding to the document image on the photosensitive drum 31. The developing unit 34 develops the electrostatic charge latent image into a toner image. Then, the toner image is transferred, through the operation of the transfer electrode 35, onto a sheet which is fed when registration rollers 56, serving as the second sheet feed means, start rotation.

Actually, after the sheet arrives at the registration rollers 56, a process of forming the toner image on the photosensitive drum 31 is started synchronously when the sheet is fed upon start of rotation of the registration rollers 56.

For this purpose, the distance from the exposure portion to the transfer electrode 35 and that from the registration rollers 56 to the transfer electrode 35 are set equal so that the toner image and the sheet overlap at the transfer region where the transfer electrode 35 exists. Also, the linear velocities of the photosensitive drum 31, the registration rollers 56, and pre-transfer rollers 57 are set equal.

The toner-image-transferred sheet is separated from the photosensitive drum 31 by the operation of the discharging unit 36, is heated and pressed by the fixing unit 9, and is discharged outside the copying machine.

The photosensitive drum 31 that has passed through the transfer region further continues rotation. The residual toner on the photosensitive drum 31 is accordingly removed by the cleaning means 37, to prepare for next image formation.

Returning to the description of the arrangement, in the sheet storing section 4, sheet feed trays 400, 410, and 420 which store sheets P in a stacked state are arranged in the vertical direction (the sheets P are shown only in the sheet feed tray 400). The respective sheet feed trays have exclusive sheet feed rollers 401, 411, and 421 and pairs of separation rollers 403, 413, and 423 serving as double-feed preventive separating means such that they can be withdrawn integrally.

The sheet feeding section 5 has convey roller pairs (to be also referred to as convey rollers hereinafter) R1, R2, R3, R4, R5, and R6 as convey means which convey the sheets P from the corresponding sheet feed trays 400, 410, and 420 to the image forming section 3.

The convey rollers R1 to R3 are preferably formed as pre-registration rollers integrally with the sheet feed trays 400, 410, and 420, and are integrally formed with them in this embodiment.

Reference symbols PS denote photosensors. For example, a photosensor PS has a function of detecting whether or not a sheet P fed from the sheet feed tray 400 by the sheet feed roller 401 has reached the convey roller pair R1 formed downstream of the separation rollers 403. This photosensor PS is disposed at a position immediately before the convey rollers R1.

Reference numeral 55 denotes convey rollers provided downstream of the convey rollers R4 in the convey direction of the sheet P. The convey rollers 55 are formed at a merge portion of a convey path for a sheet fed again through the reversal convey section 8 and a convey path for a sheet fed from, e.g., the sheet feed tray 400.

Reference numeral 56 denotes the registration rollers serving as the second sheet feed means; and 57, the pre-transfer rollers.

The reversal delivery/re-feeding section 6 is a region where a sheet after transfer and fixing is reversely delivered and the sheet P is fed again in accordance with the double-sided image formation mode. The reversal delivery/re-feeding section 6 has the switching means (already described) 62 which switches the convey paths when the sheet P delivered by the fixing delivery rollers 61 is to be directly delivered outside the copying machine, when the sheet is to be turned over and then delivered, and when the sheet P is to be fed again toward the registration rollers 56 so that an image is formed on the reverse surface (second surface) of the sheet P.

When the sheet P on which an image has been formed is to be delivered directly, i.e., with its image-transferred surface facing up, the switching means 62 is held at the position indicated by an alternate long and short dashed line in FIG. 1. When the sheet P on which an image has been formed is to be turned over and delivered, the switching means 62 is held at the position indicated by a solid line in FIG. 1. The sheet P conveyed by the fixing delivery rollers 61 is fed to a mid position (portion) of the convey path of the reversal delivery/re-feeding section 6 provided with the rollers 600 and rollers 610. The operation of the roller group is stopped simultaneously when the trailing end of the sheet P reaches a position before the convey rollers 600. After that, the convey rollers 600 are rotated in the opposite direction to that described above. As a result, the sheet P is passed on the left side of the switching means 62 and is delivered to a delivery tray 64 outside the copying machine through the delivery rollers 63.

In the double-sided image formation mode for forming an image on the second surface of the sheet successively to the first surface, the switching means 62 is held at the position indicated by the solid line in FIG. 1. The sheet P conveyed by the fixing delivery rollers 61 is fed to the reversal convey section 8 through the respective convey rollers 600 and 610 of the reversal delivery/re-feeding section 6 which are driven by a delivery motor. After the sheet P is turned over at the reversal convey section 8, it is fed out toward the registration rollers 56.

The process that takes place while a transfer image is obtained on the second surface of the sheet P is the same as that described above. After the fixing process; the sheet P is delivered in either manner described above.

The reversal convey section 8 has a convey roller pair 800 which is controlled to drive so that it feeds the sheet P conveyed by the convey rollers 610 further to the right, is stopped rotating when it clamps the trailing end of the sheet P, and is then rotated in the reverse direction. The sheet P is conveyed along a convey path which extends from a mid point of conveyance to the left by the reverse rotation of the convey roller pair 800, forms an arc upward, and then extends to the right.

Reference numerals 803, 805, 807, 809, and 811 as well as 800 denote a plurality of convey roller pairs (to be merely referred to as convey rollers hereinafter) formed along the convey path of the reversal convey section 8.

Figure 2:
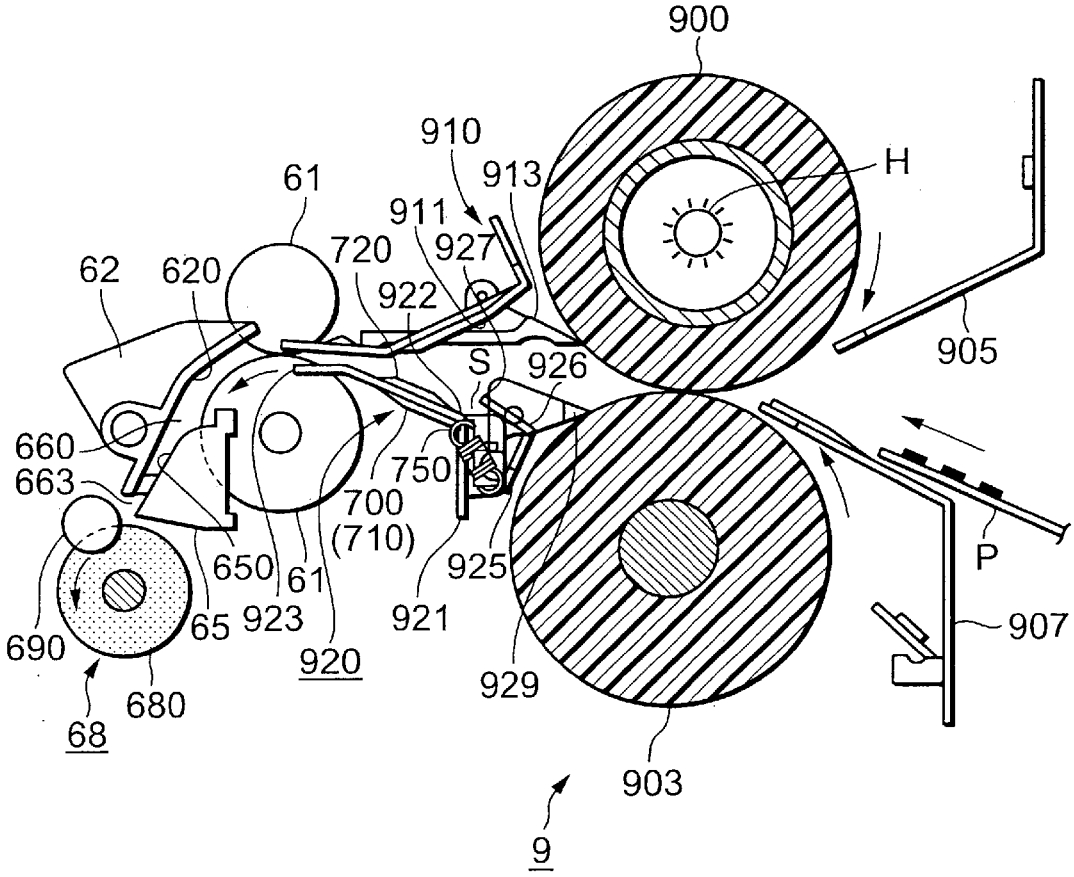
FIG. 2 is an enlarged view of the arrangement of the main part of a fixing unit in order to explain it.

FIG. 2 is an enlarged descriptive view showing the arrangement of the main part of the fixing unit. The right side in FIG. 2 corresponds to the inlet of the sheet P which is conveyed by the convey belt 38 after the transfer process. In FIG. 2, the same members (means) as those that are already described are denoted by the same reference numerals, and a repetitive description will be omitted unless it is necessary.

In FIG. 2, reference numerals 905 and 907 denote inlet side upper and lower guides, respectively.

For example, the upper fixing roller 900 described above is obtained by forming a PFA layer on a hollow metal core made of aluminum and coating the surface of the PFA layer with fluoride. The lower fixing roller 903 is obtained by forming a silicone rubber layer on an iron metal core.

Fixing temperature control can be performed by using a known technique that detects the surface temperature of the upper fixing roller 900 with a temperature sensor.

Position-fixed upper and lower guide members 910 and 920 oppose each other at the outlet of the two fixing rollers 900 and 903.

Reference numeral 913 denotes an upper separation pawl 913. The upper separation pawl 913 is controlled by a coil spring and stopper (neither is shown) so that its distal end comes close to or into light contact with part of the outer surface of the upper fixing roller 900.

A plurality of upper separation pawls 913 are arranged at appropriate intervals in the longitudinal direction of the upper fixing roller 900.

With the above arrangement, even when the sheet P after the fixing process attaches to the upper fixing roller 900 and moves upward, it is separated at its leading end from the outer surface of the upper fixing roller 900 by the upper separation pawls 913, and is sent to the left while being regulated by the lower bellies (guide portions) of the upper separation pawls 913 and a tilted guide surface 911 of the upper guide member 910, so that it is eventually sent out while being supported by the guide portion of the lower guide member 920.

The lower guide member 920 has a position-fixed first member 921 and a vertically movable second member 925.

More specifically, the first member 921 rises as it extends downstream (to the left in FIG. 2) from an upper portion (also called an upstream edge) 922 of its vertical wall on the lower fixing roller 903 side, continues to a substantially horizontal guide surface, and terminates at its end (also called a downstream edge) 923.

In other words, the first member 921 is formed such that the height of the downstream edge 923 is higher than that of the upstream edge 922 when seen along the moving direction of the sheet P.

This aims at obtaining an angle with which water vapor is prevented as much as possible from attaching to the tilted guide surface, which starts from the upstream edge 922 of the first member 921, and forming water droplets to stay on the tilted guide surface. In this embodiment, the angle formed by the tilted guide surface and the horizontal line is 20°.

The first member 921 is formed of a metal sheet, more particularly, an iron sheet, has a plurality of steps and depressions formed by drawing in the tilted guide surface (guide portion of the tilted surface), and is subjected to surface treatment by nickel plating.

Reference numeral 700 denotes steps; 710, depressions; and 720, rises.

Reference numeral 925 denotes the second member. The second member 925 has a gutter-like cross section, is entirely located closer to the lower fixing roller 903 than the first member 921, and is integrated with the first member 921 by coil springs 750 provided with respect to the first member 921.

The second member 925 can move perpendicularly (vertically) to the first member 921.

The narrow upper side of the second member 925 has a tilted surface that rises downstream from an upper portion (also called an upstream edge) 926 of its wall close to the lower fixing roller 903 and terminates at its end (also called a downstream edge) 927.

The angle formed by the upper side of the second member 925 and the horizontal line is about 30° in this embodiment.

As is apparent from FIG. 2, when the second member 925 is at the upward position (fixed position), the height of its downstream edge 927 is higher than the upstream edge 922 of the first member 921 that opposes the downstream edge 927. Accordingly, a gap S is formed between the downstream and upstream edges 927 and 922.

The gap S has a function of causing the water droplets dropping from the guide surface of the first member 921 to flow onto the second member 925.

The water droplets flowing onto the second member 925 are collected in an appropriate bottle or the like.

The height of the upstream edge 926 of the second member 925 is lower than the upstream edge 922 of the first member 921, in other words, is on the extension line of the tilted guide surface of the first member 921.

As described above, regarding the guide surfaces of the first and second members 921 and 925, their downstream edges (923 and 927) are higher than their upstream edges (922 and 926). In the lower guide member 920, the downstream edge 923 is higher than the upstream edge 926.

Reference numeral 929 denotes a lower separation pawl. The lower separation pawl 929 is supported by the first and second members 921 and 925 such that its distal end comes close to or into light contact with part of the outer surface of the lower fixing roller 903.

Figure 4:
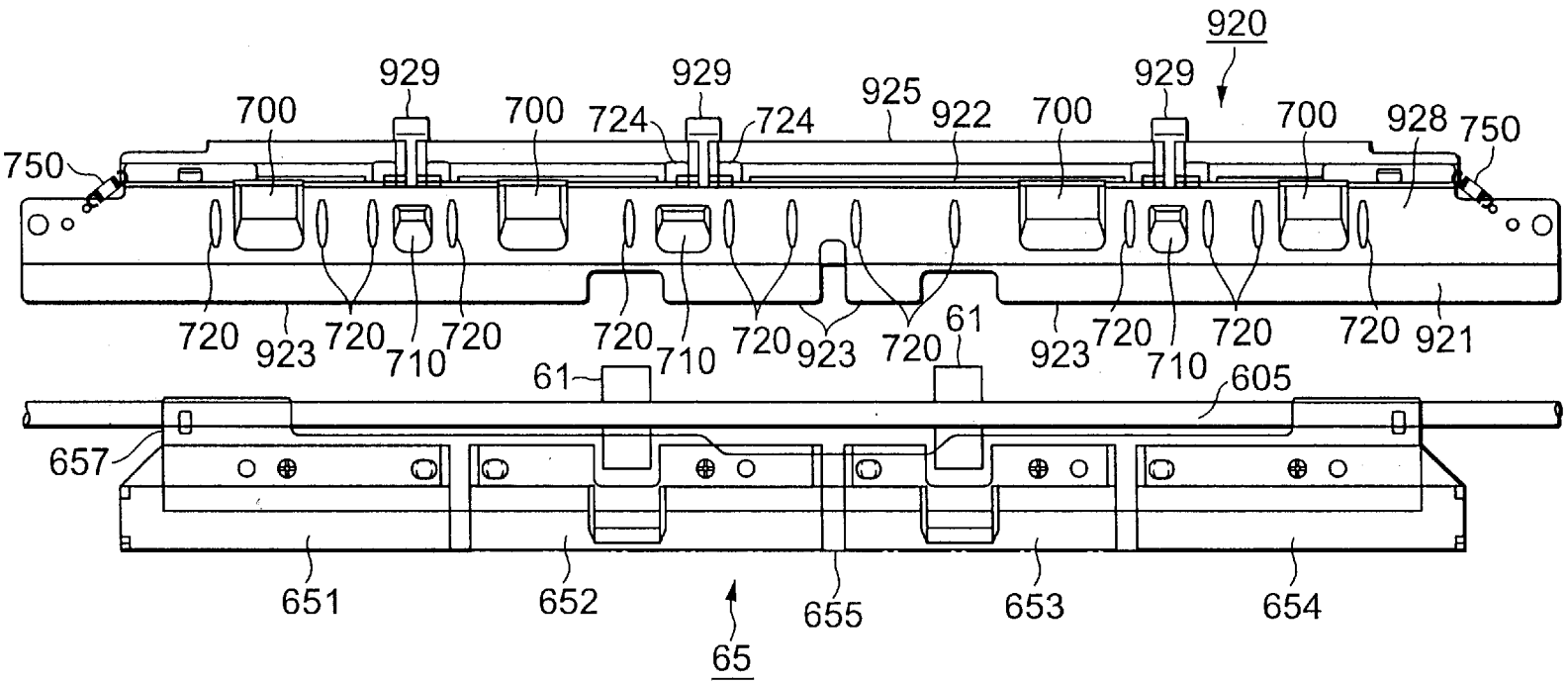
FIG. 4 is a schematic plan view of the curl correcting mechanism including a second regulating member, lower guide member, and fixing delivery rollers.

More specifically, the bottom of the lower separation pawl 929 is pushed up by the second member 925 in accordance with the function of the coil springs 750, which lie between a locking member (two projecting piece members formed at a distance from each other such that they project by utilizing the upper thin portion of the separation pawl 929 while their portions close to that base portion of the separation pawl 929 which is thicker than its upper portion do not project; denoted by 724 in FIG. 4) formed on the first member 921 and the gutter-like bottom side of the second member 925 and are arranged between the first and second members 921 and 925, so that the lower separation pawl 929 maintains a predetermined posture through locking of part of its base portion and the locking members 724.

The lower separation pawl 929 includes a plurality of separation pawls which are arranged at appropriate intervals in the longitudinal direction of the lower fixing roller 903.

In this embodiment, the top portion (upper side) of each lower separation pawl 929 forms a tilted surface which has a size almost covering the entire region occupied by the upper side of the second member 925 in the sheet convey direction, is high, and rises downstream.

Reference numeral 61 denotes the fixing delivery rollers; and 62, the switching means/first regulating member (to be referred to as the first regulating member in the description of FIG. 2, as described above). The first regulating member 62 is located at such a position in FIG. 2 where it directs the sheet P after the fixing process toward a portion for reversal delivery or re-feeding.

In other words, the sheet P after the fixing process is guided by the upper and lower guide members 910 and 920, is conveyed through the fixing delivery rollers 61 having a nip at almost the same height as those of the upper and lower guide members 910 and 920, is guided downward obliquely to the left (downward obliquely forward in the convey direction) to draw an arc while being regulated by one regulating surface (the same meaning as the guide surface) 620 which regulates the sheet P on the first regulating member 62 and a regulating surface 650 of the second regulating member 65 opposing the first regulating member 62, and approaches a predetermined position of a curl correcting means 68 provided below (downstream of) the two regulating members 62 and 65 at a predetermined angle.

The regulating surface 620 of the first regulating member 62 has a length that opposes the lower fixing delivery roller 61 as well.

The sheet convey path formed by the regulating surfaces of the first and second regulating members 62 and 65 has a wide inlet 660 and narrows toward its outlet 663.

This aims at easy acceptance of a sheet P which is slightly curled during the fixing process and at determining the sheet sending direction in a predetermined direction gradually.

The outlet end of the second regulating member 65 has a length projecting from the outlet end of the first regulating member 62, but the present invention is not limited to this.

The first and second regulating members 62 and 65 are both molded products made of PBT (polybutylene terephthalate).

In this embodiment, the second regulating member 65 which often comes into contact with the sheet P is formed of a plurality of divisional portions, preferably three or more divisional portions (which are called regulating components), that are arranged in the widthwise direction (in the obverse-to-reverse direction in FIG. 2). The gap formed by the regulating surface 620 of the first regulating member 62 and the regulating surface 650 of the second regulating member 65 is larger at its center than at its ends when seen in the widthwise direction.

The two regulating members 62 and 65 have sectional shapes each like half of a hanging bell, as shown in FIG. 2, which are substantially of the same size.

Reference numeral 68 denotes the curl correcting means having a rotatable sponge roller 680 and a press member 690 formed of a fixed round stainless steel (SUS) rod. Part of the outer surface of the press member 690 bites into the outer circumference of the sponge roller 680.

In addition to the above arrangement, the sponge roller 680 is driven to rotate at a linear velocity larger than those of the upper fixing rollers (900 and 903) so as to draw the approaching sheet P, thus correcting the curl.

Figure 3:
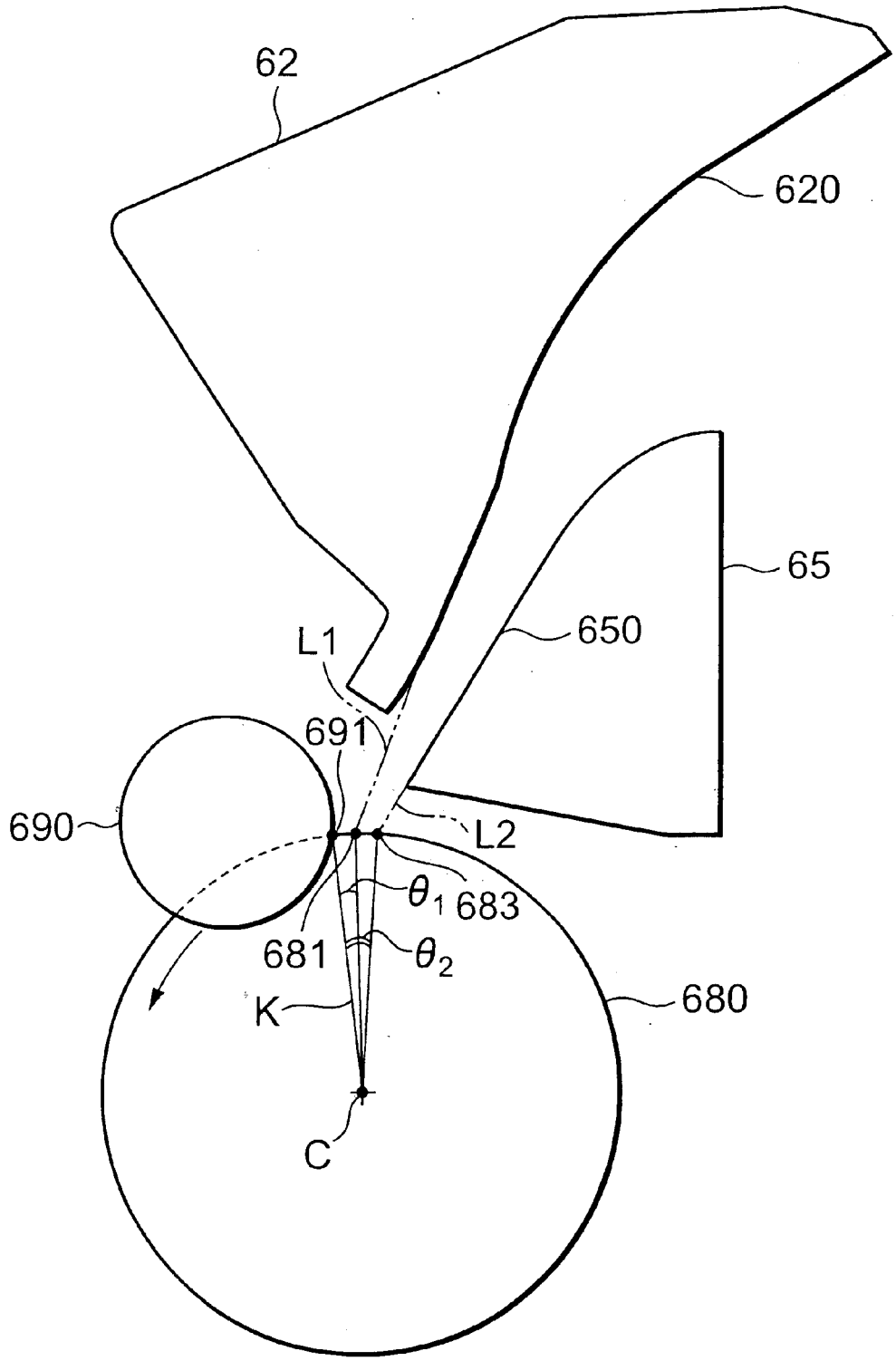
FIG. 3 is an enlarged schematic view showing the arrangement of a curl correcting mechanism and its vicinity.

Referring to the schematic enlarged view of FIG. 3 which shows the arrangement of the curl correcting means 68 and its vicinity, the regulating surface 620 of the first regulating member 62 is formed of an arcuate recessed surface formed on the sheet approaching side, and a flat surface formed on the outlet side continuously to the arcuate recessed surface. A position 681 where an extension line L1 (indicated by an alternate long and two short dashed line) of this flat surface hits the outer surface of the sponge roller 680 corresponds to the position of one end of a region where it is appropriate for the leading end of the sheet being sent to abut against the sponge roller 680.

More specifically, this indicates that position 681 on the outer surface of the sponge roller 680 which is tilted to the right (opposite to the rotating direction of the sponge roller 680) at an angle $\theta_1$ (5°) from a reference line K that connects a center C of the sponge roller 680 and a press start position (the upstream end which is in contact with the press member 690 in the rotating direction of the sponge roller 680; corresponding to the contact end of the sheet-approaching-side sponge roller 680 and the press member 690) 691 of the sponge roller 680 and press member 690.

The regulating surface 650 of the second regulating member 65 is formed of an arcuate projecting surface formed on the sheet approaching side, and a flat surface formed on the outlet side continuously to the arcuate projecting surface. A position 683 where an extension line L2 (indicated by an alternate long and two short dashed line) of this flat surface hits the outer surface of the sponge roller 680 corresponds to the position of the other end of a region where it is appropriate for the leading end of the sheet being sent to abut against the sponge roller 680.

More specifically, this indicates that position 683 on the outer surface of the sponge roller 680 which is tilted to the right (opposite to the rotating direction of the sponge roller 680) at an angle $\theta_2$ (10°) from the reference line K.

In other words, it is desirable that the leading end of the sheet P is not directed toward the press start position 691 but is regulated so as to abut against the outer surface of the sponge roller 680 within an angular range of 5° to 10° (both inclusive) from the reference line K.

If this angle is less than 5°, the leading end of the sheet P tends to easily hit the press member 690. Then, it is difficult to send the sheet P to the nip starting from the press start position 691. Paper jamming, sheet waving, or corner bent tends to occur easily.

If this angle exceeds 10°, the two corners at the leading end of the sheet may be bent, or paper jamming occurs easily.

These inconveniences are observed often particularly with a sheet having two sides which are curled by the fixing process or the like.

In this embodiment, the sponge roller 680 had a rubber hardness of 2 degrees to 12 degrees (according to the Asker C measurement). The bite amount (the amount of squeeze of the sponge roller 680, which indicates an amount from the regular outer circumference to the push-in position) of the press member 690 into the sponge roller 680 was 2.0 mm at the deepest portion. The sponge roller 680 had a diameter of 20.3 mm. The press member 690 had a diameter of 8 mm. The fixing rollers 900 and 903 had linear velocities of 320 mm/s. The sponge roller 680 had a linear velocity of 320 mm/s to 329 mm/s. The fixing rollers 900 and 903 had fixing control temperatures of 175° C. to 205° C.

The softer the rubber, the more easily the sponge roller 680 squeezes, and the larger the drawing effect. The rubber hardness within the above range is suitable because it allows easy handling of the sponge roller 680 and easy management of the linear velocities.

FIG. 4 is a schematic plan view including the second regulating member 65, lower guide member 920, and fixing delivery rollers 61, and is employed particularly for describing the arrangement of the second regulating member 65.

In FIG. 4, the same members (means) as those that are already described are denoted by the same reference numerals.

Reference numerals 651, 652, 653, and 654 denote divisional regulating components for making up the second regulating member 65, which are fixed in an array in the widthwise direction (left-to-right direction in FIG. 4) on a support 657.

For example, position fixing and position regulation can be achieved by forming holes in the support 657, forming a projection on one end of each of the components 651 to 654, fitting the holes and projections, adjusting, and fixing the support 657 and components 651 to 654 to each other with machine screws.

The adjacent regulating components are arranged at an appropriate distance. The lowest ends of the regulating surfaces of the regulating components 651 and 654 at the left and right ends are located on a reference line 655 indicated by an alternate long and two short dashed line. The lowest ends of the regulating surfaces of the regulating components 652 and 653 at the center are located at positions retreated from the reference line 655.

In other words, the regulating surfaces of the regulating components 651 and 654 at the ends are located close to the regulating surface 620 of the first regulating member 62 shown in FIG. 2, while the regulating surfaces of the regulating components 652 and 654 at the center are located far from the regulating surface 620 of the first regulating member 62, so that the convey path is large in the widthwise direction at the center.

The second regulating member 65 is divided as described above, so that when it is formed of one resin member, its warp based in thermal expansion occurring in the widthwise direction is decreased. The positions of the regulating components 652 and 653 at the center are set far from the positions of the regulating members at the two ends because thermal expansion occurs also in a direction perpendicular to the widthwise direction and because the influence of thermal expansion appears largely particularly at the center. Hence, the inconveniences in sheet conveyance can be suppressed.

The distances of retreat of the regulating components 652 and 653 from the reference line 655 can be determined appropriately, and are about 0.5 mm in this embodiment.

The fixing delivery rollers 61 form round slices which are fixed on a shaft 605.

The first member 921 which constitutes the lower guide member 920 is formed of a metal sheet, and has the plurality of steps 700, plurality of depressions 710, and plurality of rises 720, formed by drawing, in the longitudinal direction.

The "steps" refer to depressions formed in a region extending from a downstream position in a tilted guide surface 928 toward an upstream side and including the upstream edge 922 (this means that the bottom surface includes as far as the upstream edge).

The "depressions" are recesses (depressions) formed in the region of the tilted guide surface 928. The "rises" are projections formed in this region, with reference to the tilted guide surface before processing, on the opposite side to the side where the steps 700 and depressions 710 are formed, and are located within the region of the tilted guide surface 928.

The steps 700 are formed at positions phase-shifted from the lower separation pawls 929. The depressions 710 are formed at positions with almost the same phase as those of the lower separation pawls 929. The rises 720 are formed on the left and right of the steps 700 and depressions 710.

Reference numerals 724 denote the locking members. The locking members 724 serve to support the lower separation pawls 929 in cooperation with the second member 925, and are formed of part of the first member 921. Reference numerals 750 denote the coil springs. The coil springs 750 are elements that integrate the first and second members 921 and 925 to be movable relative to each other. These elements are mentioned in the description of FIG. 2.

The process in the arrangement of FIG. 2 will be briefly described by taking the arrangements of FIGS. 3 and 4 into consideration.

The sheet P after the transfer process is conveyed while it is regulated by the inlet side guides 905 and 907, and is heated and pressed by the upper and lower fixing rollers 900 and 903. Then, toner powder which forms an image on the sheet P is melted, and is fixed to the sheet P.

The leading end of the sheet P after the fixing process is fed out by the operation of the lower or upper separation pawls 929 or 913, or the like, and is regulated by the first and second regulating members 62 and 65, to abut against a predetermined region on the outer surface of the sponge roller 680 which forms the curl correcting means.

After this, the sheet P is conveyed by the rotation of the sponge roller 680, is sent to the nip with respect to the press member 690, is subjected to a drawing operation (curl correcting operation), and is fed out toward a predetermined portion of the reversal delivery/re-feeding section 6 (see FIG. 1).

In this embodiment, the switching means for the sheet convey path serves as the first regulating member as well. However, a switching means and a first regulating member can apparently be formed of separate members. The hardness and size (diameter) of the sponge roller, the amount of squeeze of the sponge roller, the size (diameter) of the press member, the linear velocities of the fixing rollers and sponge roller, and the like can also be determined appropriately.

What is claimed is:

1. An image forming apparatus having an image carrier, image forming means for forming a toner image on said image carrier, transfer means for transferring the toner image formed on said image carrier onto a transfer medium, and fixing processing means including a pair of upper and lower fixing rollers for fixing the toner image onto the transfer medium, wherein the apparatus comprises curl correcting means, including a rotatable sponge roller and a fixed press member which presses said sponge roller while biting into part of an outer surface of said sponge roller, and provided downstream of said fixing processing means, and regulating means, provided immediately before said curl correcting means, so as to guide a leading end of the fixing-processed transfer medium to that position on the outer surface of said sponge roller which is tilted, within a range of 5° to 10° (both inclusive) from a reference line that connects a center of said sponge roller and a press start position of said press member with respect to said sponge roller, to a direction opposite to a rotating direction of said sponge roller.

2. An apparatus according to claim 1, wherein said sponge roller is rotated at a linear velocity larger than those of said pair of upper and lower fixing rollers.

3. An apparatus according to claim 2, wherein the linear velocity of said sponge roller is 325 mm/s to 329 mm/s.

4. An apparatus according to claim 2, wherein said sponge roller has a rubber hardness of 2 degrees to 12 degrees (both inclusive) measured by Asker C measurement.

5. An apparatus according to claim 4, wherein said press member bites into said sponge roller by a bite amount of 2.0 mm at a deepest portion.

6. An apparatus according to claim 1, wherein said regulating means comprises a first regulating member which has a regulating surface formed of an arcuate recessed surface formed on an approaching side of the fixing-processed transfer medium and a flat surface formed on an outlet side of the transfer medium continuously to the arcuate recessed surface, and a second regulating member which has a regulating surface formed of an arcuate projecting surface formed on an approaching side of the fixing-processed transfer medium and a flat surface formed on an outlet side of the transfer medium continuously to the arcuate projecting surface, and which is arranged to oppose said first regulating member.

7. An apparatus according to claim 1, further having, downstream of said curl correcting means, a reversal delivery/re-feeding mechanism for reversely delivering and re-feeding the transfer medium which is curl-corrected through said regulating means and said curl correcting means.

8. An apparatus according to claim 7, wherein said regulating means further comprises a convey path switching member which can direct the transfer medium toward said reversal delivery/re-feeding mechanism.

* * * * *